US005572835A

United States Patent [19]

Atkins et al.

[11] Patent Number: 5,572,835

[45] Date of Patent: Nov. 12, 1996

[54] TELESCOPING FLAGPOLE

[75] Inventors: Dallas R. Atkins, Eastlake; Anthony M. Manfredi, Cleveland, both of Ohio

[73] Assignee: HMI Industries, Inc., Cleveland, Ohio

[21] Appl. No.: 383,999

[22] Filed: Feb. 6, 1995

[51] Int. Cl.[6] ..... F04H 12/34; G09F 17/00

[52] U.S. Cl. ..... 52/111; 52/110; 116/173; 403/377; 403/350; 248/407; 248/410

[58] Field of Search ..... 52/110, 111, 109, 52/118; 248/533, 410, 411, 407, 125.1, 125.2, 125.6; 403/350, 351, 352, 109, 377; 116/173, 174

[56] References Cited

U.S. PATENT DOCUMENTS

| | | | |
|---|---|---|---|
| 1,062,850 | 5/1913 | Pratt | 116/174 X |
| 1,119,147 | 12/1914 | Fillmore | 116/174 X |
| 1,845,143 | 2/1932 | Friesner | 248/410 X |
| 2,324,614 | 7/1943 | Dalton | 52/110 X |
| 2,992,026 | 7/1961 | Farber | 403/351 |
| 3,183,886 | 5/1965 | Moffitt et al. | 116/173 |
| 3,515,418 | 6/1970 | Nielsen, Jr. | 403/377 X |
| 4,076,437 | 2/1978 | Mazzolla | 248/411 X |
| 4,811,983 | 3/1989 | Watts et al. | 248/407 X |
| 4,918,896 | 4/1990 | Wiese | 52/111 |

*Primary Examiner*—Carl D. Friedman
*Assistant Examiner*—Winnie Yip
*Attorney, Agent, or Firm*—Vickers, Daniels & Young

[57] ABSTRACT

A flagpole is provided for displaying a flag, the flagpole comprises at least one longitudinally extending tubular segment and rotatable flag engaging rings concentrically disposed on the tubular segment. One of the rotatable flag engaging rings includes a pawl device, concentrically disposed on the tubular segment, for allowing only uni-directional lateral movement of one of the flag engaging rings.

15 Claims, 7 Drawing Sheets

FIG. 1

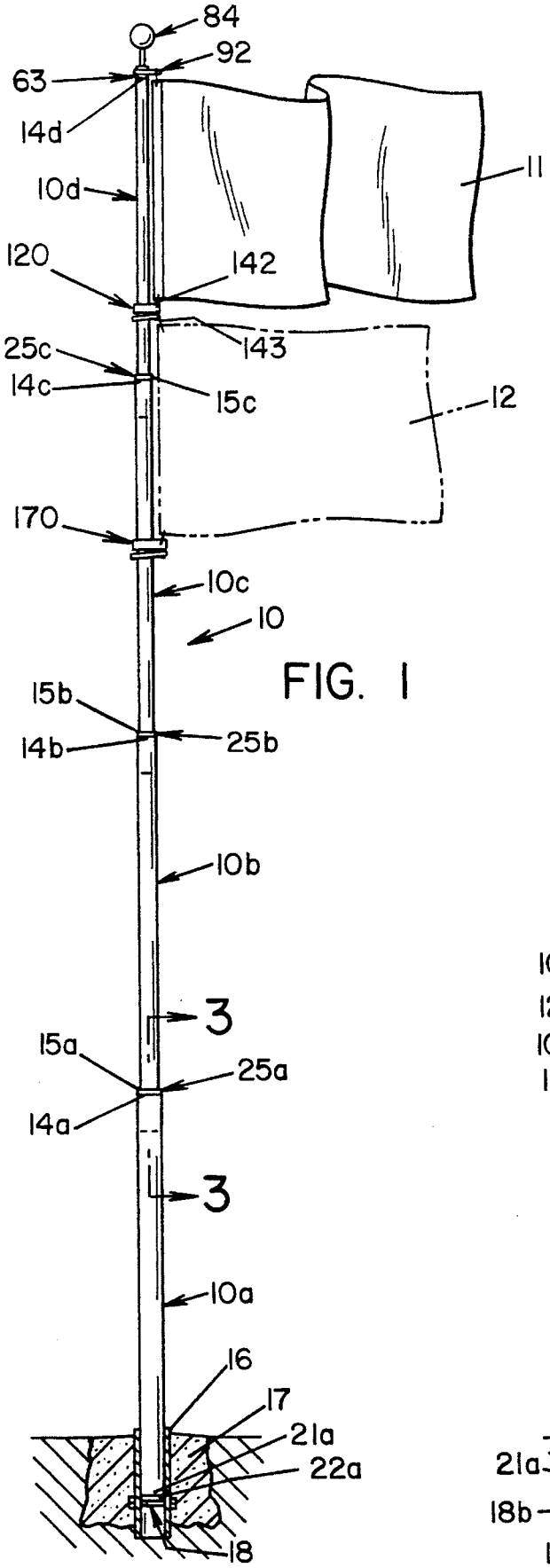
FIG. 1
FIG. 2
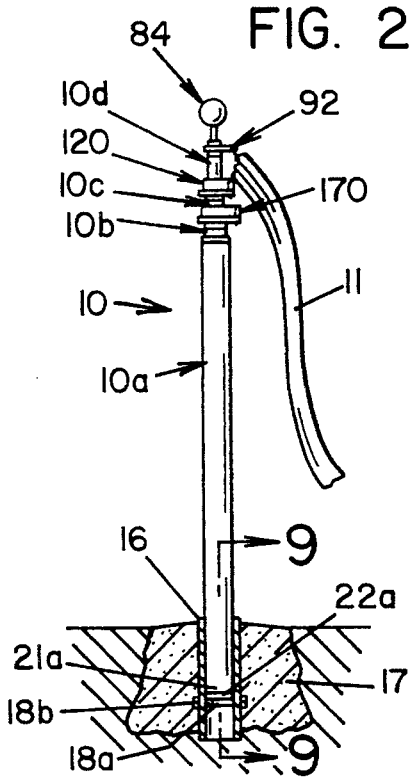

TELESCOPING FLAGPOLE

The present invention relates to a telescoping flagpole assembly and a mechanism for attaching a flag to such a flagpole. However, it will be appreciated that the invention is applicable to any type of flagpole which includes a device to prevent a flag from wrapping around or becoming entangled on the flagpole.

BACKGROUND OF THE INVENTION

Most flagpoles can be separated into three categories. The first type of flagpole is single, tubular rigid flagpole which is permanently installed and include a halyard for raising and lowering the flag. The second is a telescoping flagpole comprised of a plurality of telescoping segments which are extendable to a displayed position and can be retracted and nested within adjacent telescoping segments facilitating storage and simplifying the raising and lowering of the flag. The third type of flagpole is the short tubular type which is typically one or two fixed one segments. These are common residential flagpoles and are often seen mounted on an angle on the side of a house or garage. As mentioned above, the permanently installed flagpoles, use a halyard to hoist a flag. A pulley or tackle is ordinarily provided at the top of the flagpole in order that a flag may be hoisted. A rope with snap hooks extends from the pulley to the ground. The snap hooks are used to engage grommets on the edge of the flag. Such flags, when hoisted, have a tendency to wrap around a flagpole in varying wind conditions. This is also true of short one section residential flagpoles which commonly use a fixed eyelet on a pole or simple rope to permanently tie off the flag to the flagpole.

The use of telescoping flagpoles has substantially eliminated a number of these problems. Telescoping flagpoles typically comprise a plurality of telescoping tubular segments. The bottommost segment is of the greatest diameter and is permanently fixed to the ground or slidably received within a ground socket. The uppermost segment is fitted with a flag engaging mechanism to which the flag is attached. Such flag engaging mechanism may take the form of typical eyelets or other fasteners which are permanently affixed to the top most segment. Additionally, telescoping flagpoles may use rotatable rings to attach the flag to the flagpole. The top flag engaging ring is maintained in place adjacent the top end of the uppermost segment while a bottom flag engaging segment is freely slidable along at least the top most segment. This allows that the top most segment may be telescoped within the next intermediate segment. Further, the freely slidable bottom most ring, being coupled with an upper ring which is capable of rotating on top of the mast, provides a mechanism which prevents the flag from wrapping, twisting or otherwise becoming entangled around the flagpole. This is an advantageous feature of telescoping flagpoles which is not otherwise practical on large single segment flagpoles. Specifically, there is no ability to raise a bottom most flag engaging ring or otherwise to access the top flag engaging ring except by a halyard. The halyard then prevents the flag engaging rings from being freely rotatable about the flagpole. Telescoping flagpoles, on the other hand, allow for the flag engaging rings to be brought to ground level, the flag placed thereon, and the entire pole assembly to be raised. This distinctive advantage of a telescoping flagpole also presents a disadvantage. As the wind catches the flag and the flag flies freely, the flag will begin to billow like a sail causing it to bulge or swell out. The wind force causing this billowing pulls on the flag at the flag attachments. Since the bottom flag attachment is both rotatable and slidable along the flagpole, the wind forces pull axially upward on the bottom flag attachments. This causes the flag to billow and bulge even more severely wherein the bottom flag attachment is pulled up even further. Soon the flag resembles a wind sock in appearance. Conventional flag attachments do not have this problem since the bottom most attachment is normally tied off with the rope at ground level. However, such a tie off would delete one of the innovative advantages of a telescoping flagpole. The advantage being, as discussed above, a flag attachment which allows the flag to fly freely in the wind without wrapping around the pole.

For the same reasons as above, prior art telescoping flagpoles are also not amenable to flying a second flag simultaneously below and upper flag. Two flags simply exaggerate the billowing effect. Additionally, prior art telescoping flagpoles are not equipped to fly a flag at a half mast.

Other disadvantages of telescoping flagpoles are seen in the mechanisms provided to limit maximum extension of the tubular segments and the locking mechanisms utilized to lock the flagpole in place at the maximum extension. Prior art telescoping flagpoles generally show a locking pin cooperable with an aperture in an adjacent telescoping segment. As shown in Wiese U.S. Pat. No. 4,918,896, incorporated by reference herein, a spring loaded locking pin on the smaller tubular segment engages the aperture opening on the adjacent larger tubular segment upon full extension of the mast, thus holding adjacent segments in an extended position. Such locking mechanism does not provide for intermediate extension of the flagpole. Further, as disclosed in Wiese '896, separate and distinct internal bushing rings spaced downwardly from the upper ends are required within each of the bottom and intermediate segments to limit the upward extension of adjacent tubes. Such prior art telescoping flagpoles require the manufacture of additional parts and an additional installation step in the assembly of such flagpoles. The added complexity increase the time and cost of manufacture and assembly. Further, the resulting number of internal parts increases the likelihood of adjacent ill-fitting sections and also increases maintenance requirements.

SUMMARY OF THE INVENTION

Accordingly, the present invention overcomes the disadvantages of prior art flagpoles by providing an improved flag attachment which prevents the billowing of the flag while allowing the flag to fly freely in the wind without twisting or wrapping around the pole.

More particularly in this respect, the flag engaging mechanism includes a billowing prevention device which is concentrically disposed about the flagpole and prevents the bottom flag engaging attachment from upward lateral movement along the flagpole.

The present invention solves many of the prior art problems by providing a flag attachment which allows the flag to fly freely in the wind, without wrapping around the flagpole or becoming entangled therewith. The flag attachment includes a device that allows for only uni-directional lateral movement of the flag attachment along the flagpole. This device is concentrically disposed on the tubular segment of the flagpole.

In a preferred embodiment, a flag is attached to a tubular telescoping flagpole by attaching the flag to first and second rotatable devices concentrically disposed on the topmost tubular segment of the flagpole. Each of the first and second rotatable devices includes an opening together with a clip which engages a grommet at the corner of a flag. Preferably, the top most rotatable device is rotatable but not slidable along the flagpole while the bottom rotatable device is both rotatable about the flagpole and slidable in lateral directions along the flagpole. The uni-directional device allows the bottom flag attachment to freely move downward along the tubular segment. In this position, the tubular segments may be extended upward to display a flag. Gravity forces pulling on the bottom flag attachment keep the flag relatively taut between the upper and lower flag attachments. However, when the wind begins to blow, the flag begins to pull at both the top and bottom flag attachments. The top flag attachment cannot move since it is rotatably fixed at the uppermost section of the mast. The bottommost flag attachment is prevented from moving axially upwardly by the uni-directional lateral movement device. Preferably, such uni-directional device is a lever concentrically disposed and rotatable about the flagpole. The lever is pivotably attached to the bottommost flag attachment device in order that upward movement of the bottommost flag attachment device causes the lever to twist against the tubular segment and act as a pawl preventing upward lateral movement. As the bottommost segment attempts to move down the tubular segment, the lever is disengaged and allows easy lateral movement.

The pawl device prevents unwanted billowing of the flag on a telescoping flagpole thus providing all the advantages of a standard lanyard type flagpole without the disadvantages thereof.

In accordance with another aspect of the invention the flagpole is easy to use and requires no ropes, pulleys or tiedowns. Each section of the pole raises and lowers independently, and locks securely in place. With the pole in the closed position, the flag can be simply attached to the attachment hooks. Each section is then raised, and locked securely into place with a slight twist. The process can be reversed to lower the flagpole. Preferably, the pole is equipped with a ground sleeve to allow complete removal of the pole for storage. The entire pole can either be lifted from the ground tube for easy storage or permanently mounted therein.

Further, in accordance with the present invention, the locking mechanism includes cooperable cam wheels which, when rotated, wedge adjacent tubular segments of the flagpole into a locking position. Further, the invention preferably includes a bearing collar at the top end of each telescoping segment having an inner diameter, the second cam wheel having an outer diameter greater than the inner diameter of the bearing collar to limit upward extension of adjacent inner telescoping segments. This feature advantageously allows upward extension of the telescoping segments to be limited without the addition of separate bushing rings or other devices to limit such extension.

It is thus an outstanding object of the invention to provide a flagpole assembly with an improved flag attachment that allows the flag to fly freely without wrapping around the pole.

It is yet another object of the invention to provide a flagpole assembly which limits the upward lateral movement of the bottommost flag attachment.

Still another object of the invention is to provide an improved locking device which allows for intermediate locking of each of the telescoping segments.

Yet another object of the invention is to provide a locking device which limits upward extension of adjacent inner telescoping segments without additional assemblies.

These and other objects of the invention will become apparent to those skilled in the art upon reading and understanding the detailed description in the following section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 1 is an elevation view partially in section of the telescoping flagpole according to the invention;

FIG. 2 is an elevation view partially in section of the flagpole in a retracted position;

THE PREFERRED EMBODIMENT

Figure 3:
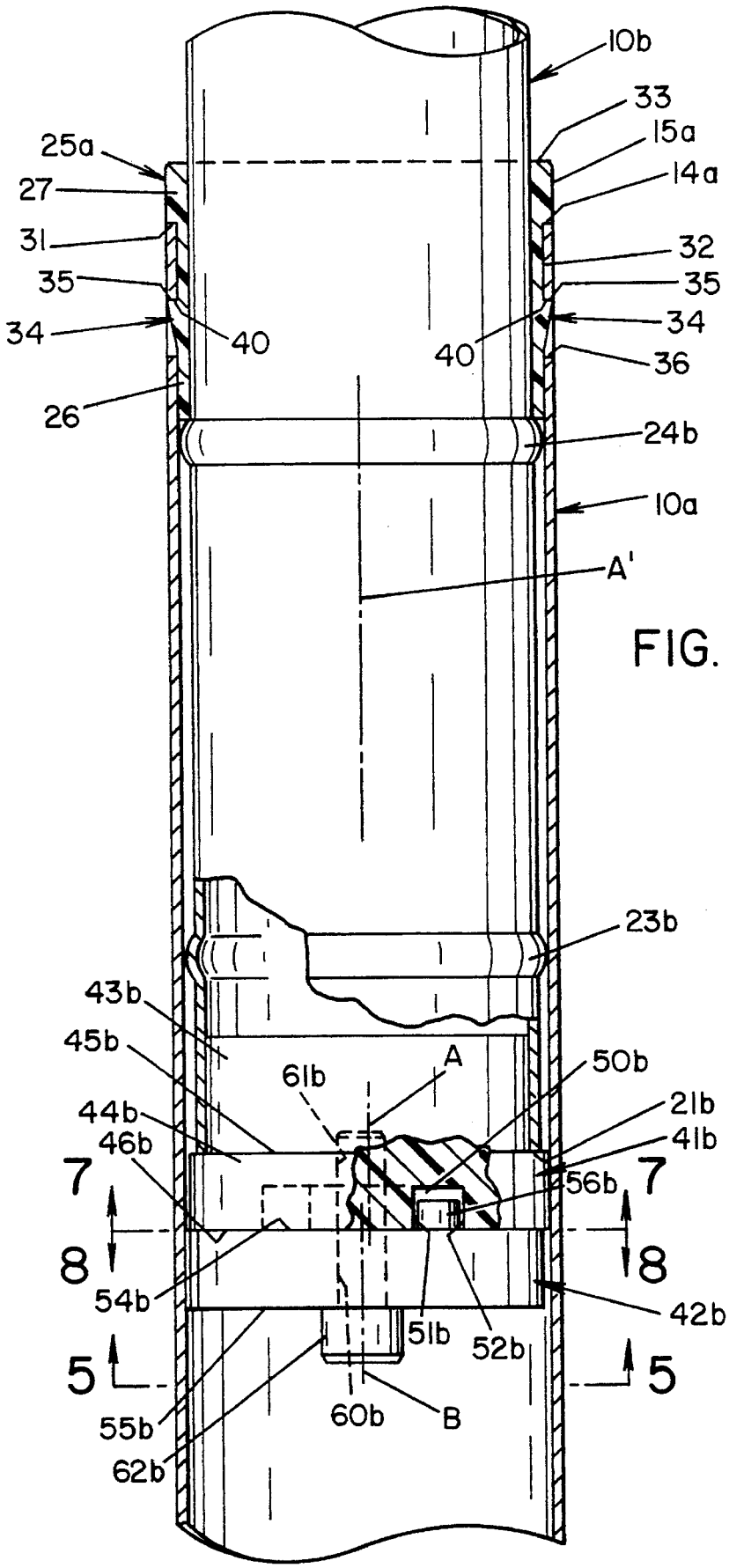
FIG. 3 an enlarged view in section taken along line 3—3 of FIG. 1.

Referring to the drawings, wherein the showings are for the purpose of illustrating the preferred embodiment of the invention only and not for the purpose of limiting same, FIG. 1 shows a telescoping flagpole 10 according to the present invention, including four cylindrical tubular tubes or sections, 10*a*, 10*b*, 10*c* and 10*d*. As shown, flagpole 10 is adapted to fly at least one flag 11 and may fly a second alternate flag 12. At an upper end 14*a*–14*c* of tubes 10*a*–10*c* are bearing collars 15*a*–15*c*. At upper end 14*d* of tube 10*d* is a separate element which will be described hereinafter. Flagpole 10 is preferably mounted within ground sleeve 16. For greater rigidity ground sleeve 16 is set in concrete 17. Ground sleeve 16 is a hollow cylindrical tube having an inside diameter equal to or slightly greater than the outside diameter of tube 10*a* and includes a hex head bolt 18*a* and nut 18*b* inserted through the center of ground sleeve 16 orthogonal to the longitudinal axis and adjacent the bottom end in order to limit the downward extension of tube 10*a*. The bottom end 21*a* of tube 10*a* includes a bearing collar virtually identical to bearing collar 15*a* to prevent metal to metal contact between tube 10*a* and hex head bolt and nut 18. Bearing collar 22*a* further eliminates damage to flagpole 10 caused by repetitive removal and reinsertion of flagpole 10 into ground sleeve 16. It will be appreciated that flagpole 10 may be installed in a manner other than shown or may be permanently installed within ground sleeve 16.

FIG. 2 shows flagpole 10 in a retracted state. In such state flag 11 may be attached to flagpole 10 and upwardly extended to the position shown in FIG. 1. In order to extend flagpole 10, obviously tube 10*d* is extended first, tube 10*c* extended second, and tube 10*c* extended last.

Figure 9:
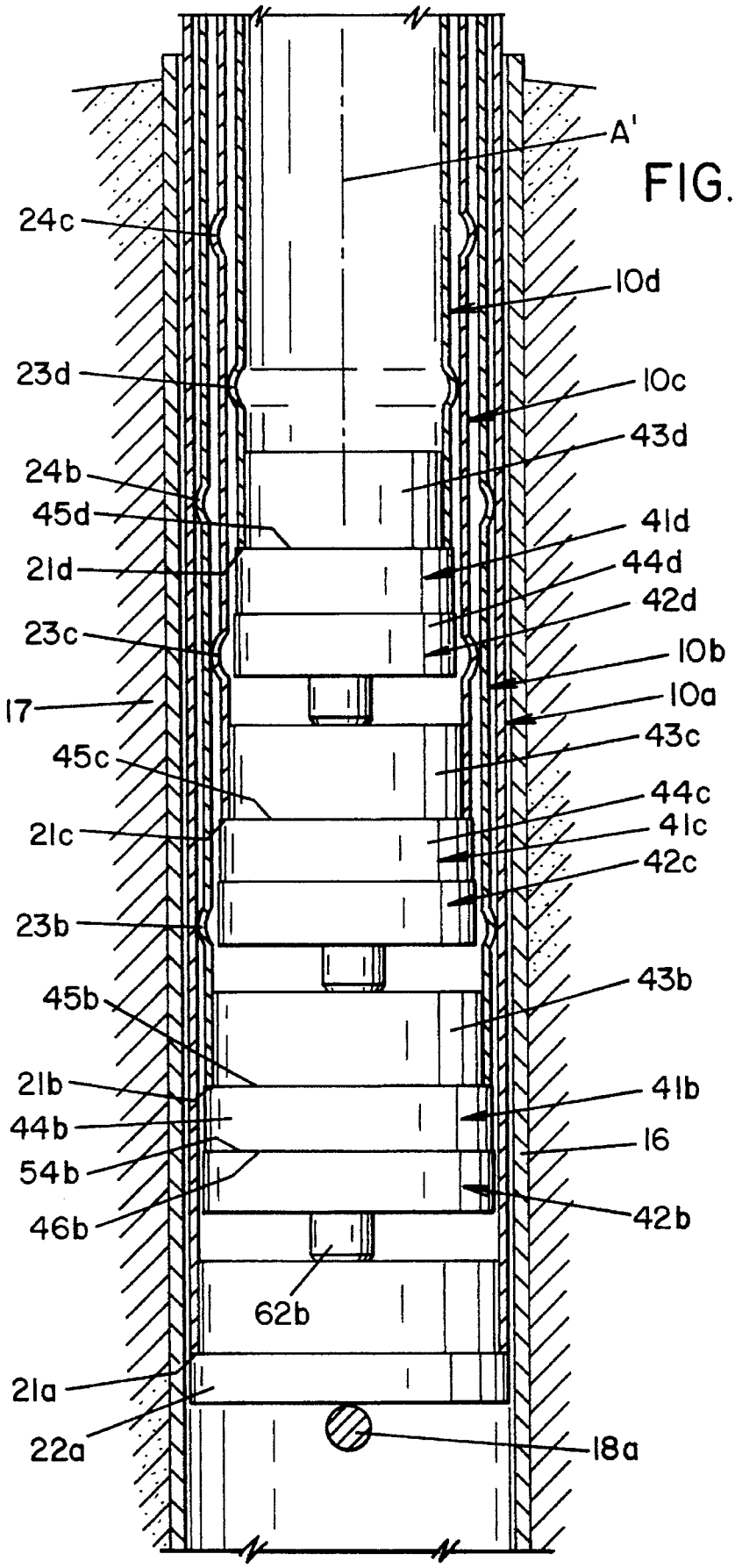
FIG. 9 is a cross-sectional view taken along line 9—9 of FIG. 2.

As best shown in FIGS. 3 and 9 each of tubes 10*b*–10*d* include bottom ends 21*a*, 21*b*, 21*c* and 21*d*, two annular detent ribs 23, 24 and specifically annular detent ribs 23*b*, 24*b* located on tube 10*b*, ribs 23*c*, 24*c* located on tube 10*c* and ribs 23*d*, 24*d* located on tube 10*d*. Rib 24*i* is not shown. Each of annular detent ribs 23*b*–23*d* and 24*b*–24*d* are adjacent bottom ends 21*b*, 21*c*, 21*d*, respectively, with ribs 23*b*–23*d* being directly adjacent to bottom ends 21*b*–21*d* while ribs 24*b*–24*d* are slightly spaced upwardly therefrom. Detent ribs 23*b*–23*d* and 24*b*–24*d* are formed as slight undulations in tubes 10*b*–10*d* and extend outwardly therefrom. As such, no additional assembly parts are required. Detent ribs 23*b*–23*d* and 24*b*–24*d* serve to facilitate sliding within the adjacent outer tube and also provides a bearing surface between adjacent tubes when flagpole 10 is in an extended locked position as shown in FIG. 3. This bearing surface prevents one tube from wobbling with respect to an adjacent tube. Finally, detent ribs 24*b*–24*d* serve to prevent detachment of adjacent telescoping sections in order that the tubes cannot be pulled apart.

Figure 10:
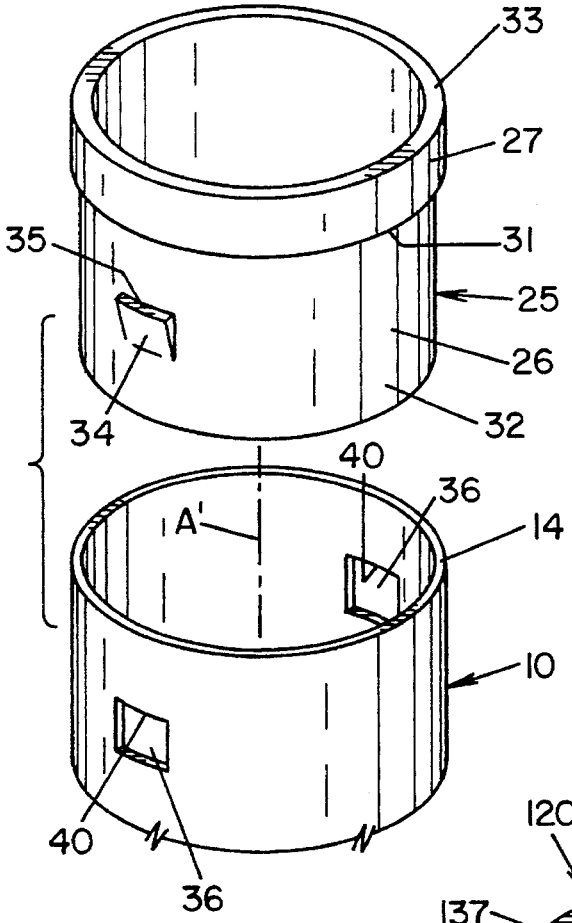
FIG. 10 is an assembly view of another feature of the telescoping flagpole.

Standard bushings 25*a*–25*c* are fitted at the upper ends 14*a*–14*c* of each of telescoping flagpole segments 10*a*–10*c*. A generic standard bushing is shown in FIG. 10 and will be described generically. It will be appreciated that the assembly shown in FIG. 10 is identical for each of standard bushings 25*a*–25*c*. Standard bushing 25 includes integral cylinder portion 26 and annular ring 27. The inside diameter of cylinder 26 and annular ring 27 is generally equal while the outside diameter of annular ring 27 is greater than the outside diameter of cylinder portion 26. As such, a bearing portion 31 adjacent and orthogonal to an outer surface 32 of cylinder portion 26 is formed. Opposite bearing portion 31 is an upper ring surface 33, which is generally parallel to bearing surface 31 and orthogonal to annular ring 27. Each bushing includes two burrs 34 extending from outer surface 32. A notch engaging surface 35 is located on each burr 34 and is opposite and parallel to bearing surface 31. Bushing 25 is snugly fitted into one of tubes 10*a*–10*c* by means of notches 36 located adjacent upper end 14 of tube 10. Notches 36 have a rectangular shape generally equal to the outer peripheral shape of burrs 34. Each of notches 36 include an upper surface 40 parallel to upper end 14 and adjacent thereto. The distance between upper surface 40 and upper end 14 is generally equal to the distance between bearing surface 31 and notch engaging surface 35. It will appreciated from FIG. 10 that bushing 25 is inserted within tube 10 such that bearing surface 31 engages upper end 14 while burrs 34 engage notches 36. Bushing 25 is prevented from being withdrawn from tube 10 by notch engaging surface 35 bearing against upper surface 40. Engagement between bushings 25*a*–25*c* and detent ribs 24*b*–24*d* also prevents the detachment and pulling apart of adjacent telescoping sections as described generally above.

As best shown in FIGS. 3, and 5–9, telescoping flagpole 10 is locked into an extended position by cooperable non-concentric cam wheels 41*b*, 41*c*, 41*d* and 42*b*, 42*c* and 42*d*, respectively. Each of wheels 41*b*–41*d* and 42*b*–42*d* has a common center axis A' which is coaxial with the center axis A' of telescoping flagpole 10. However, cam wheels 42*b*, 42*c* and 42*d* are rotatable relative to cam wheels 41*b*, 41*c* and 41*d*, respectively about offset rotation axis B. Rotation axis B is offset from common center axis A by 0,062 inches. Cam wheels 41*b*, 41*c* and 41*d* include an integral solid cylindrical plug 43*b*, 43*c* and 43*d* depending from disc portions 44*b*, 44*c* and 44*d*, respectively. Solid cylindrical plugs 43*b*, 43*c* and 43*d* have a smaller outside diameter than disc portions 44*b*, 44*c* and 44*d*, respectively, in order that cylindrical plug 43*b*, 43*c* and 43*d* can be fitted within the bottom ends 21*b*, 21*c* and 21*d* of each of tubes 10*b*, 10*c* and 10*d* while disc portions 44*b*, 44*c* and 44*d* protrude beyond bottom ends 21*b*, 21*c* and 21*d*. Thus, a disc bearing surface 45*b*, 45*c* and 45*d* is in surface to surface contact with bottom end 21*b*, 21*c* and 21*d*, respectively.

The remainder of the details of cooperable non-concentric cam wheels 41*b*, 41*c*, 41*d* and 42*b*, 42*c*, 42*d* are described with specific reference to FIG. 3, FIGS. 5–8 and cam wheels 41*b* and 42*b*. It will be appreciated that these details are identical for cam wheels 41*c*, 41*d* and 42*c*, 42*d*. A disc outer surface 46*b* of cam wheel 41*b* includes a track recess 50*b* in the shape of a half moon. Track recess 50*b* extends approximately half of the way around disc portion 44*b* and is defined by semi-circular inner lip 51*b* and semicircular outer lip 52*b*. Each of inner lip 51*b* and outer lip 52*b* are centered about the common center point defined by rotation axis B and perpendicular axis C. Track recess 50*b* extends approximately 180° and is bounded at opposite ends by lip edge portions 53*b* located in the general vicinity of axis C. Cam wheel 42*b* includes an inwardly facing surface 54*b* and an outwardly facing surface 55*b*. Cylindrical pin 56*b* depends from inwardly facing surface 54*b*. A cylindrical opening 60*b* is located in cam wheel 42*b* between surface 54*b* and surface 55*b*. A cylindrical threaded hole 61*b* is located between disc bearing surface 45*b* and disc outer surface 46*b* of cam wheel 41*b*. Both opening 60*b* and hole 61*b* are coaxial with rotation axis B and, when in substantial registry, are adapted to receive hex head cap screw 62*b* to complete the assembly of cam wheels 41*b* and 42*b*.

Figure 6:
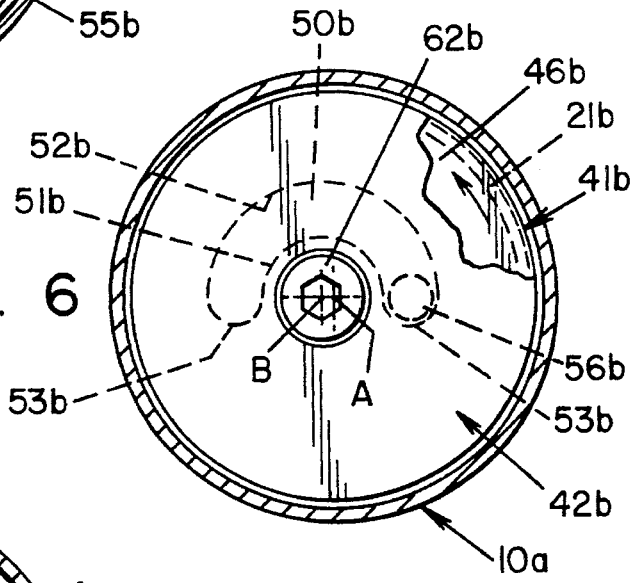
FIG. 6 is a cross-sectional view of the locking mechanism shown in FIG. 5 in an unlocked position.
Figure 7:
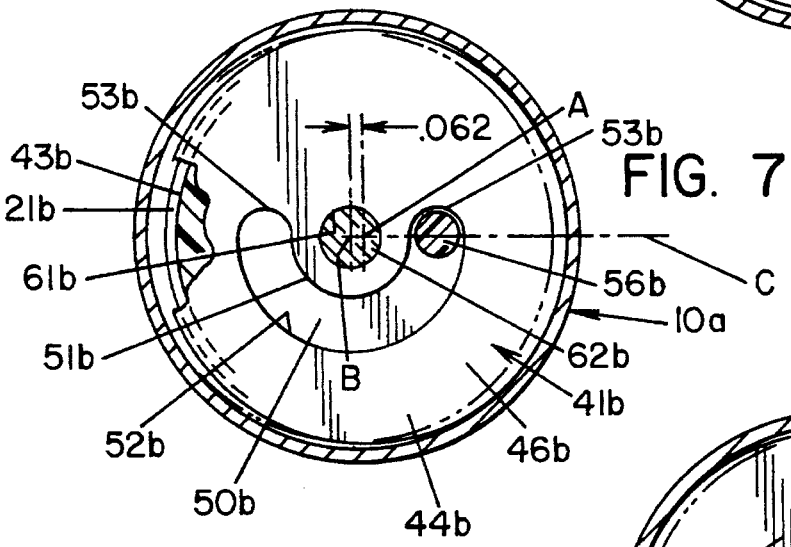
FIG. 7 is a cross-sectional view taken along line 7—7 of FIG. 3.
Figure 8:
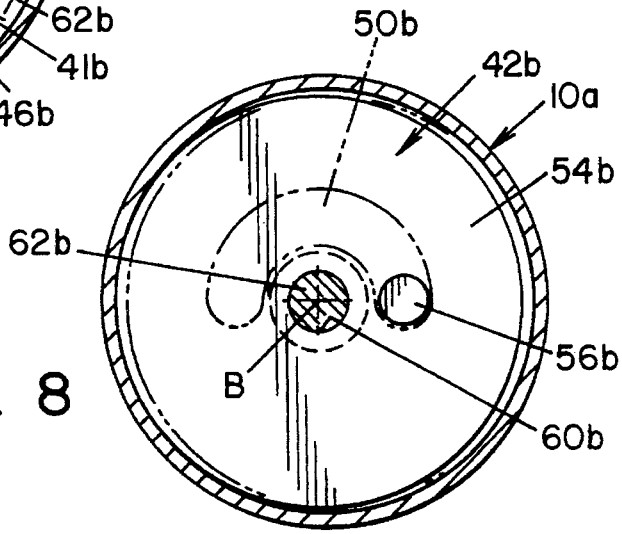
FIG. 8 is a cross-sectional view taken along line 8—8 of a FIG. 3.

As assembled, inwardly facing surface 54*b* is adjacent and in surface-to-surface contact with disc outer surface 46*b*. Cylindrical pin 56*b* is received within track recess 50*b*. Cylindrical pin 56*b* has an outside diameter generally corresponding to the radial difference between inner lip 51*b* and outer lip 52*b*. Cap screw 62*b* allows cam wheel 42*b* to rotate with respect to cam wheel 41*b*. Cylindrical pin 56*b* limits rotation of cam wheel 42*b* through 180°. FIG. 6 shows the assembly of FIG. 5 in an unlocked position wherein each of cam wheels 41*b* and 42*b* are concentric. Due to rotation about rotation axis B, which is offset from common center axis A, cam wheel 42*b* becomes non-concentric with respect to cam wheel 41*b* when rotated from the position shown in FIG. 6 to any other position, including the positions shown in FIGS. 3, 5, 7 and 8, each of which shows the preferred locking position. In the unlocked position of FIG. 6, cam wheels 41*b*, 42*b* easily slide within tube 10*a* which allows relative movement of tube 10*b* within tube 10*a*. Once tube 10*b* has been moved into an extended position, rotation of tube 10*b* with a simple twist through 180° causes the rotation of cam wheel 42*b* and the relative camming action shown in FIGS. 3, 5, 7 and 8. Thus, further relative sliding is prevented between tubes 10*b* and 10*a* in order that tube 10*b* is in an extended locked position. Reference in the discussion hereinabove has been limited to cam wheels 41*b* and 42*b* which lock tube 10*b* within tube 10*a*. It will be appreciated that cam wheels 41*c*, 42*c* and cam wheels 41*d*, 42*d* act in an identical manner and differ only in size, said size being relative to the size of each individual tube 10*b*, 10*c*, 10*d* of telescoping flagpole 10.

Figure 4:
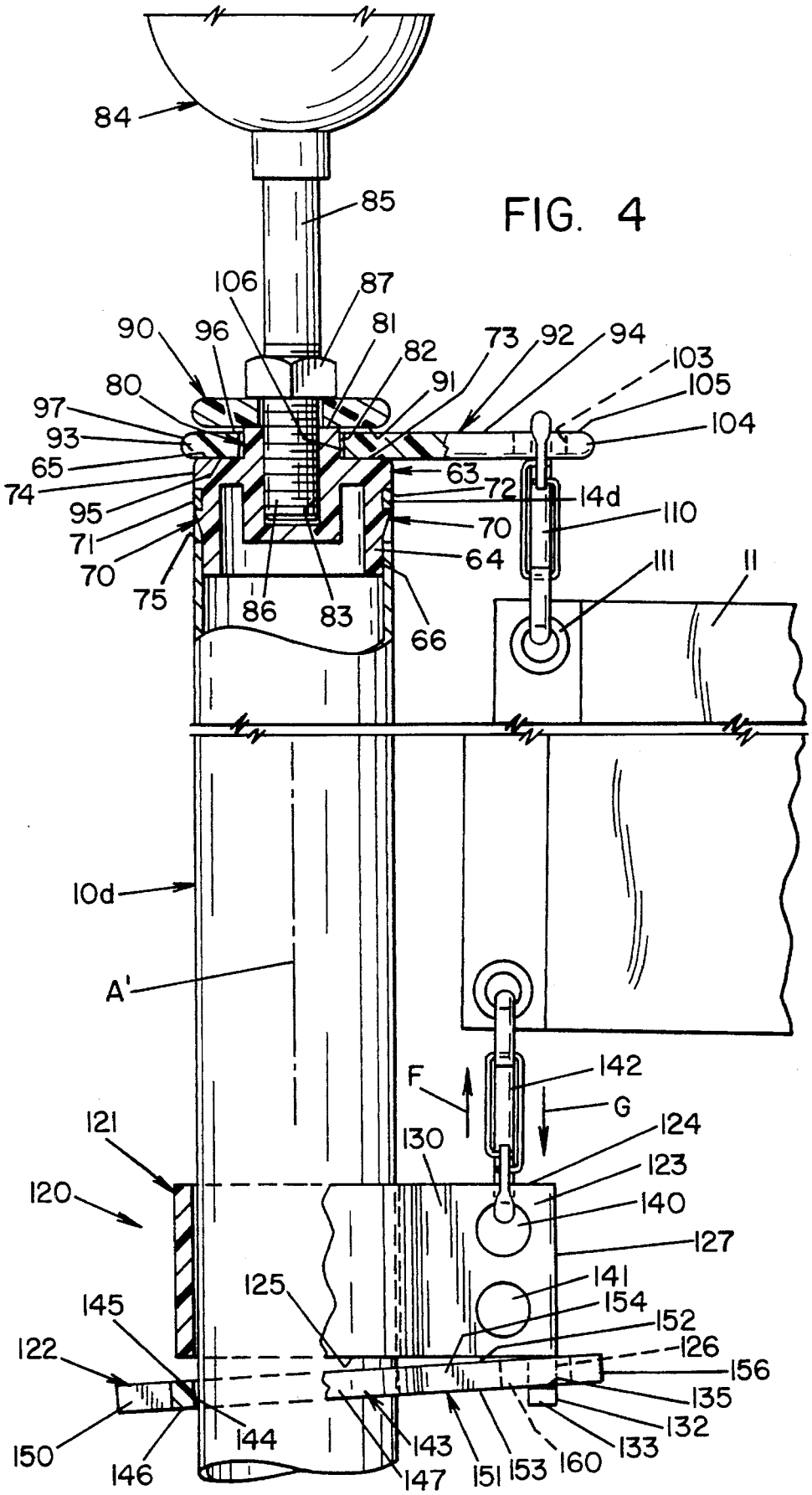
FIG. 4 is an enlarged view of the flagpole partially in section showing the connection system between the flag and flagpole.
Figure 5:
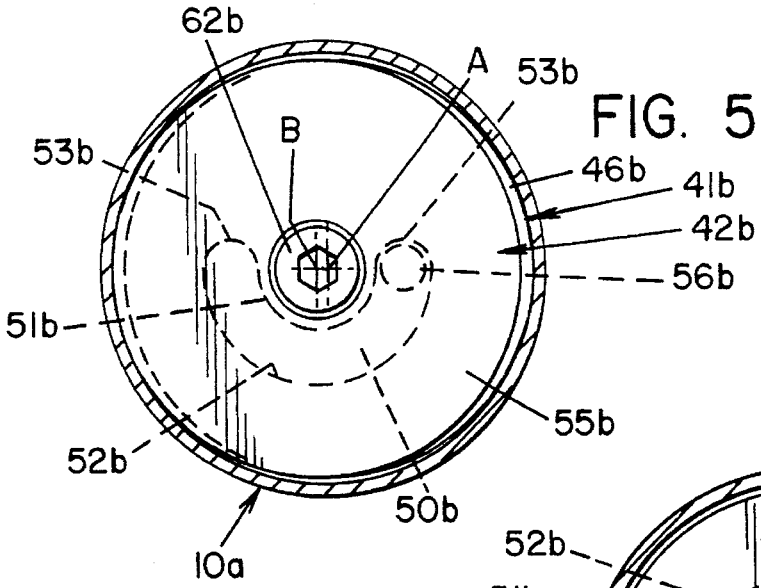
FIG. 5 is a cross-sectional view taken along line 5—5 of FIG. 3.
Figure 12:
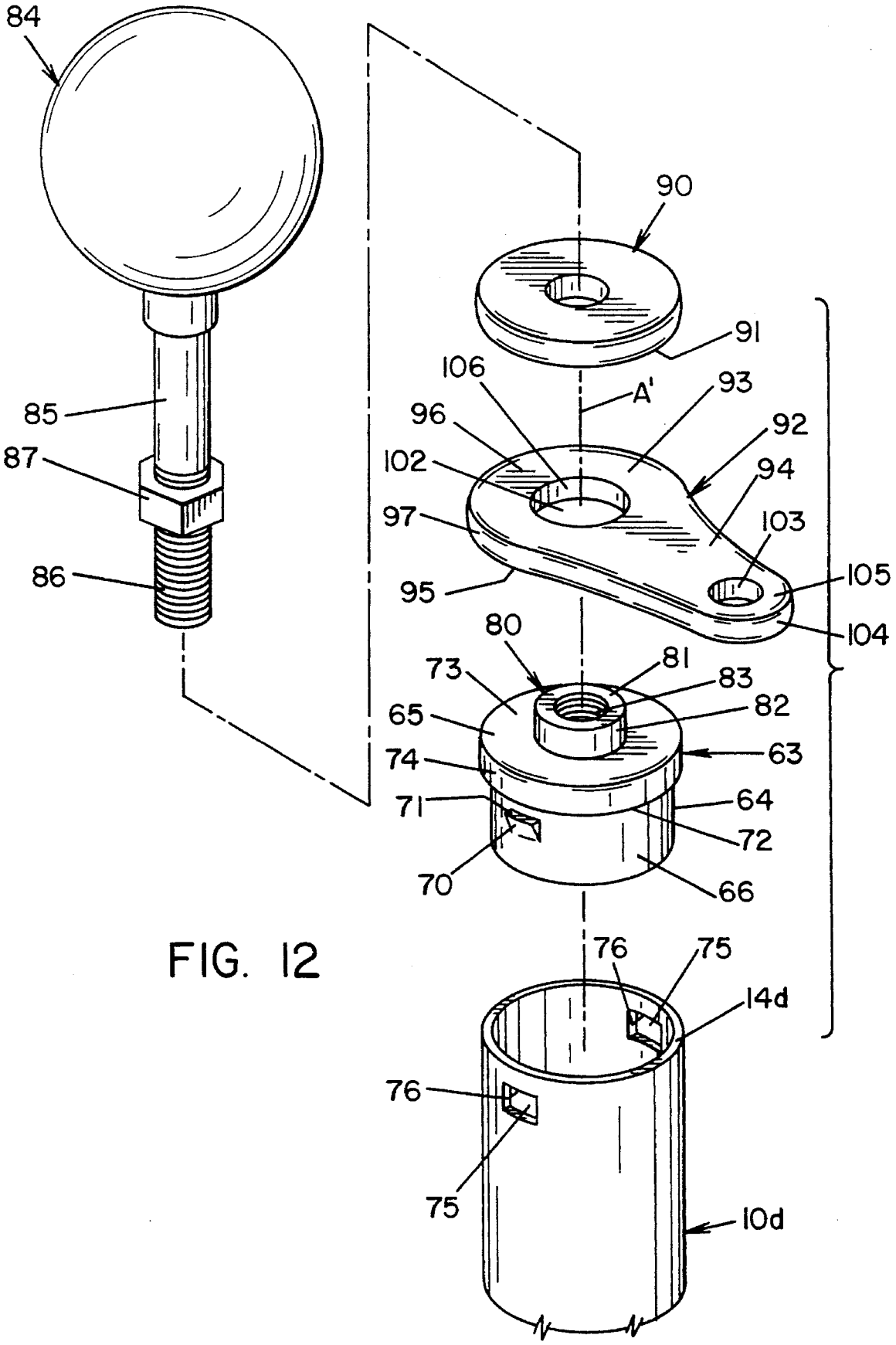
FIG. 12 is an assembly view showing a connection mechanism of the flagpole utilized between the flagpole and the flag.

Referring now to FIGS. 4 and 12, upper end 14*d* of tube 10*d* includes an upper end plug 63 including an integral solid cylinder 64 and disc portion 65. Disc portion 65 has a larger outside diameter than solid cylinder 64. The outer surface 66 of cylinder 64 includes two cylinder burrs 70, only one of which is shown in FIG. 12. Cylinder burrs 70 includes an upper notch engaging surface 71 which is opposite a downwardly facing bearing surface 72 on disc portion 65. Also on disc portion 65 and parallel to bearing surface 72 is engaging ring surface 73. Ring surface 74 connects bearing surface 72 and engaging ring surface 73. Tube 10*d* includes notches 75 adjacent upper end 14*d*. Notches 75 are relatively rectangular in shape and include an upper surface 76 for engagement with notch engaging surface 71. Upper end plug 63 fits into tube 10*d* much like standard bushings 25*a*–25*c* fit into tubes 10*a*–10*c*. Bearing surface 72 is in surface-to-surface contact with upper end 14*d* to prevent further downward extension of plug 63 within tube 10*d*. Interengagement between burrs 70 and notches 75 and specifically between notch engaging surface 71 and upper surface 76 prevents removal of plugs 63 from tube 10*d*. Further integral with plug 63 and located on engaging ring surface 73 is a bearing ring 80 concentric with both disc portion 65 and solid cylinder 64. Bearing ring 80 includes a bearing end surface 81 which is relatively parallel with engaging ring surface 73, and a bearing ring outer surface 82 extending therebetween. The outer diameter of bearing ring 80 is smaller than either of disc portion 65 or solid cylinder 64. Upper end plug 63 includes a threaded hole 83 coaxial with center axis A' for receiving an ornamental top closure such as the sphere 84 shown in FIG. 12. Sphere 84 includes a shank 85 depending therefrom which is at least partially threaded in the region 86 with threads corresponding to tapped hole 83. Sphere 84 also includes a nut 87 to be threaded over the region 86 and brought into tight interengagement with washer 90 of which bottom surface 91 bears against bearing end surface 81.

Disposed about bearing ring 80 is a rotatable flag engaging ring 92 having a washer portion 93 and a finger portion 94 extending therefrom. Flag engaging ring 92 is generally planar and includes a bottom disc engaging surface 95 and a parallel top surface 96 with an edge surface 97 extending therebetween. Rotatable flag engaging ring 92 is generally kidney shaped and includes a circular opening 102 within washer portion 93 and a circular hole 103 adjacent a tip 104 of finger portion 94 forming a lip 105 between tip 104 and circular hole 103.

As best seen in FIG. 12, the circular opening 102 includes an inside rim 106 having a diameter slightly greater than the outside diameter of bearing ring 80. As seen in FIG. 4, when assembled, flag engaging ring 92 is rotatable through 360° about center axis A' and bearing ring 80. Disc engaging surface 95 lays flat upon engaging ring surface 73 and is retained thereon by washer 90 placed upon bearing end surface 81 and held in place with shank 85 and nut 87 of sphere 84. Obviously, other bolt like connections can be used in place of sphere 84. As shown in FIG. 4, the grommet engaging clip 110 is attached between grommet 111 of flag 11 and circular hole 103 of finger portion 94 of flag engaging ring 92. Each of upper end plug 63, flag engaging ring 92 and washer 90 is preferably made of a non-metallic material such as a plastic material having a low coefficient friction to facilitate rotation of flag engaging ring 92 relative to upper end plug 63 and washer 90. Applicant has found that white nylon is suitable for this purpose. Additionally, each of the standard bushings 25*a*–25*c* and cam wheels 41*b*, 41*c*, 41*d* and 42*b*, 42*c*, 42*d* are also preferably constructed of white nylon.

Figure 11:
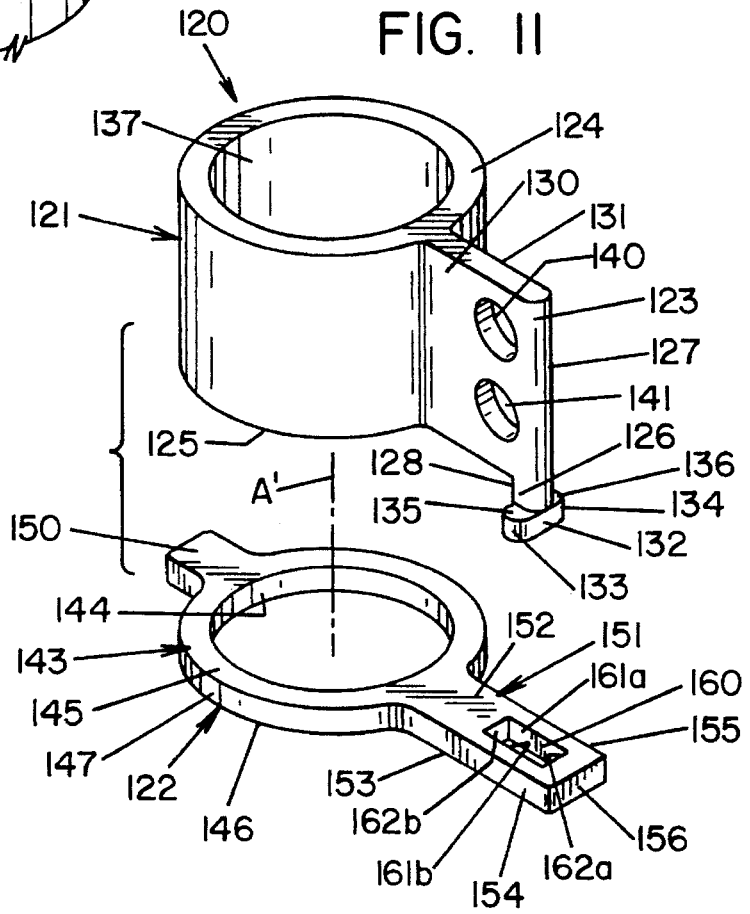
FIG. 11 is an assembly view of a connection mechanism between the flag and the flagpole according to the present invention.

As best seen in FIGS. 4 and 11, flagpole assembly includes a flag engaging ring 120 comprised of cylindrical portion 121 disposed concentrically about tube 10d and a pawl portion 122 connected to cylindrical portion 121. A grommet engaging portion 123 extends from cylinder portion 121, is a relatively flat planar sheet and extends the axial length of cylinder portion 121 parallel to center axis A'. Both cylinder portion 121 and grommet engaging portion 123 include a common top edge surface 124 and a common bottom edge surface 125. A finger 126 extends from bottom edge surface 125 along a coaxial edge 127 which is generally parallel to center axis A'. Finger 126 is further defined by an inside finger edge 128, opposite and parallel to coaxial edge 127. Grommet engaging portion 123 includes parallel outer surfaces 130 and 131, finger 126 being coplanar with both outer surfaces 130 and 131. A key 132 depends from finger 126 and has two opposite ends 133 and 134 which extend from each of outer surfaces 130 and 131, respectively. Each of opposite ends 133 and 134 include an upper bearing portion 135 and 136 extending from parallel outer surfaces 130 and 131, respectively, and orthogonal thereto. Grommet engaging portion 123 further includes two holes 140 and 141 adjacent and aligned parallel to coaxial edge 127. Hole 140 is adapted to receive a grommet engaging clip 142 while hole 141 is adapted to receive an optional grommet engaging clip 143, as shown in FIG. 1, when it is desired to fly a second flag 12. It will be appreciated that cylindrical portion 121 is coaxial with tube 10*d* and rotatable through 360° about center axis A'.

Pawl portion 122 includes a plate portion 143 concentrically disposed about tube 10*d* and rotatable through 360° about center axis A'. Plate portion 143 includes an inside rim 144 having the inside diameter generally corresponding to the inside diameter of an inside surface 137 of cylindrical portion 121. Plate portion 143 also includes an upper edge surface 145 and a lower edge surface 146 and an outer rim 147. Upper edge surface 145 and lower edge surface 146 extending between inside rim 144 and an outer rim 147. Plate portion 143 also includes a knob 150 extending outwardly therefrom, transverse to center axis A'. Opposite to knob 150 is a lever arm 151 also extending transverse to center axis A'. Lever arm 151 is relatively rectangular in shape and defined by an upper surface 152 a lower surface 153 and lever edges 154 and 155 extending therebetween. Adjacent an outboard tip edge 156 is a rectangular keyway 160 having opposite inside walls 161*a* adjacent and parallel lever edge 155 and inside wall 161*b* adjacent and parallel to lever edge 154. Walls 161*a*, 161*b* are connected by inside wall 162*a* adjacent and parallel to outboard tip edge 156 and inside wall 162*b*, which is opposite and parallel to inside wall 162*a*. The preferred distance between inside walls 161*a* and 161*b* is 0.325 inches while the distance between inside walls 162*a* and 162*b* is 0.62 inches. Keyway 160 is thus adapted to receive and retain finger 126 which has a width between opposite parallel outer surfaces 130 and 131 equal to 0.153 inches and a length between opposite coaxial edge 127 and inside finger edge 128 of 0.255 inches.

As can be seen from FIGS. 4 and 11, cylindrical portion 121 and pawl portion 122 of flag engaging ring 120 are connected together by the insertion of finger 126 and key 132 within rectangular keyway 160. As assembled and placed on tube 10*d* as shown in FIG. 4, cylinder portion 121 is coaxial with plate portion 143. On tube 10*d*, flag engaging ring 120 is freely slidable axially along tube 10*d* and further is rotatable through 360° about axis A'. Thus, flag 11 will always fly freely regardless of changes in wind direction. Instead of wrapping around the pole, flag engaging ring 120 and flag engaging ring 92 rotate with the flag.

A common problem in prior art rotatable flag engaging rings, as discussed above, is that prior art equivalents to engaging ring 120 tend to slide upwardly on the pole creating a billowing effect of the flag. Consequently the flag had the appearance of a wind sock rather than the banner appearance intended. Pawl portion 122 prevents wind forces from pulling flag engaging ring 120 upwardly towards flag engaging ring 92. As flag engaging ring 120 attempts to slide upwardly due to the wind on the flag pulling grommet engaging clip 142 in the direction of arrow F, pawl portion 122 pivots about finger 126 thus camming plate portion 143, and specifically inside rim 144 into frictional contact with tube 10*d*, as shown in FIG. 4. Further wind forces (represented by arrow F) tend to cam plate portion 143 of pawl 122 into tighter contact with tube 10*d*. As can be seen from FIGS. 1 and 4, lower surface 153 of lever arm 151 tends to rock on upper bearing portion 135 and 136 of key 132 in order to provide the pivoting effect. The distance between opposite ends 133 and 134 of key 132 is preferably 0.545 inches, which is sufficient to support lever arm 151 thereon, which has a width between lever edges 154 and 155 of 0.76 inches. When no forces are applied on flag engaging ring 120, gravity forces, in the direction of arrow G, pull flag engaging ring 120 to the lower most position possible on tube 10*d*. Only grommet engaging clip 142 prevents ring 120 from sliding into engagement with tube 10*c*. It will be appreciated that when flag engaging ring 120 slides in the downward direction of arrow G, upper surface 152 of lever arm 151 abuts bottom edge surface 125 of grommet engaging portion 123 and upper edge surface 145 of plate portion 143 abuts bottom edge surface 125 of cylindrical portion 121. Thus, the camming action of pawl portion 122 is eliminated and flag engaging ring 120 is allowed to slide freely in a downward direction. Therefore, the combination of cylindrical portion 121 and pawl portion 122 act to allow only uni-directional lateral movement of flag engaging ring 120 along axis A' and prevents billowing of a flag.

It will be appreciated that two or more flags may be stacked and flown as shown in FIG. 1. Flag 12 may be attached to flag engaging ring 120 via hole 141 and a second flag engaging ring 170 be provided. Flag engaging ring 170 would be identical to flag engaging ring 120 except for specific dimensional requirements. As shown, flag engaging ring 170 would be relatively larger since it is axially slidable on tube 10*c* of the flagpole assembly, instead of tube 10*d*. Flag engaging ring 120 and optional flag engaging ring 170 are made from a plastic material and preferably polycarbonate. Such material allows axial sliding along metal tube 10*d* or tube 10*c* while providing sufficient frictional forces during the camming action to prevent upward axial sliding and thus only allows uni-directional movement.

The invention has been described with reference to the preferred embodiment. Obviously modifications and alterations will occur to others upon reading and understanding this specification. For example, the materials described herein are preferred and contemplate use with a metal tubular flagpole. Obviously, flagpoles constructed of fiberglass, plastics or other materials can be used. In such cases, it may be desirable to manufacture cylinder portion 120 and pawl portion 122 from other materials. It is intended to include these modifications and all such other modifications and alterations in so far as they come within the scope of the invention.

Having thus described the invention it is claimed:

1. A telescoping flagpole assembly for displaying a flag, said assembly comprising:

a plurality of interengaging telescoping segments slidable between a retracted position and an extended position, locking means for securing adjacent segments in said extended position, means for engaging said flag on said segments including means for allowing said flag to rotate about said segments, said flag engaging means including means for preventing billowing of said flag, said billowing prevention means concentrically disposed about said flagpole, said rotatable flag engaging means including a first flag engaging ring and a second flag engaging ring, said billowing prevention means including means for stopping lateral movement of said rotatable flag engaging means and including pawl means on said first flag engaging ring for frictionally engaging one of said segments to prevent upward lateral movement along said telescoping segment, said first flag engaging ring including a cylindrical portion disposed concentrically about said segment and said pawl means including a lever pivotably connected to said first flag engaging ring.

2. The telescoping flagpole of claim 1, wherein said lever includes a plate portion having a hole therein, said plate portion concentrically disposed about said telescoping segment.

3. The telescoping flagpole of claim 2, wherein said first flag engaging ring includes a flag portion extending from said cylindrical portion, said lever pivotably connected to said flag portion.

4. A telescoping flagpole assembly for displaying a flag, said assembly comprising:

a plurality of interengaging telescoping segments slidable between a retracted position and an extended position, locking means for securing adjacent segments in said extended position, means for engaging said flag on said segments including means for allowing said flag to rotate about said segments, said flag engaging means further including pawl means concentrically disposed about said flagpole for preventing billowing of said flag; said rotatable flag engaging means including a first flag engaging ring and a second flag engaging ring, said pawl means including a lever depending from said first flag engaging ring for frictionally engaging said one of said segments to prevent upward lateral movement along said telescoping segments.

5. The flagpole assembly of claim 4, wherein said lever includes a plate portion concentrically disposed about said one of said segments.

6. The flagpole assembly of claim 5, wherein said plate portion of said lever frictionally engages said one of said segments.

7. A flagpole for displaying a flag, said flagpole comprising at least one longitudinally extending tubular segment, first and second rotatable means concentrically disposed on said tubular segment for attaching said flag on said flagpole, said first rotatable means connected to means for stopping unidirectional lateral movement of said first rotatable means along said flagpole, said lateral stopping means concentrically disposed on said tubular segment, said lateral stopping means including lever means rotatable about said flagpole, said lever means including a plate portion concentrically disposed about said flagpole and an arm extending therefrom, said arm pivotably attached to said first rotatable means.

8. The flagpole of claim 7, wherein said first rotatable means includes a cylinder portion disposed on said tubular segment and a grommet engaging portion extending therefrom for attaching to said flag.

9. The flagpole of claim 8, wherein said grommet engaging portion is a relatively flat sheet extending the axial length of said cylinder portion and including a finger depending from said sheet for attaching to said arm.

10. The flagpole of claim 9, wherein said finger includes a key having at least two ends, said two ends projecting from opposite sides of said flat sheet, said arm including a keyway disposed therein, said finger interengaging with said keyway.

11. The flagpole of claim 10, wherein said keyway is a rectangular opening having a length and a width said key having a length between said two ends greater than said opening width and less than said opening length.

12. The flagpole of claim 11, wherein said arm has an upper surface, a lower surface and a thickness therebetween and said finger has a length between said sheet and said key, said finger length greater than said arm thickness.

13. The flagpole of claim 12, wherein said flat sheet is disposed adjacent said upper surface of said arm, said key is disposed adjacent said lower surface of said arm, and said finger is retained by said key in said rectangular opening.

14. The flagpole of claim 8, wherein said grommet engaging portion includes at least one hole therein for fastening said flag to said first rotatable means.

15. The flagpole of claim 14, wherein said grommet engaging portion includes two holes.

* * * * *